United States Patent [19]

Ogata et al.

[11] 4,432,845

[45] Feb. 21, 1984

[54] METHOD OF PRODUCING TIN-FREE STEEL SHEETS HAVING IMPROVED RESISTANCE TO RETORTING TREATMENT

[75] Inventors: Hajime Ogata; Toshio Ichida; Shunichi Tsugawa; Toshio Irie, all of Chiba, Japan

[73] Assignee: Kawasaki Steel Corporation, Kobe, Japan

[21] Appl. No.: 513,662

[22] Filed: Jul. 14, 1983

[30] Foreign Application Priority Data

Jul. 20, 1982 [JP] Japan ..... 57-126042

[51] Int. Cl.[3] ..... C25D 5/02; C25D 11/38

[52] U.S. Cl. ..... 204/56 R; 204/35 R; 204/38 A

[58] Field of Search ..... 204/35 R, 38 A, 56 R

[56] References Cited

U.S. PATENT DOCUMENTS

| | | | |
|---|---|---|---|
| 2,812,296 | 11/1951 | Neish | 204/56 R |
| 3,296,100 | 1/1967 | Yonezaki et al. | 204/56 R |
| 3,446,717 | 5/1969 | Farquar et al. | 204/56 R |
| 3,479,162 | 11/1969 | Yanabu et al. | 204/56 R |
| 3,691,055 | 9/1972 | Hamada et al. | 204/56 R |
| 3,756,926 | 9/1973 | Brown et al. | 204/56 R |
| 3,794,572 | 2/1974 | Yamagishi et al. | 204/56 R |
| 3,860,398 | 1/1975 | Tsurumaru et al. | 204/56 R |
| 4,082,620 | 4/1978 | Skurkiss | 204/56 R |
| 4,145,263 | 3/1979 | Tsutsui et al. | 204/56 R |
| 4,248,676 | 3/1981 | Uchida et al. | 204/56 R |

*Primary Examiner*—Arthur P. Demers

*Attorney, Agent, or Firm*—Young & Thompson

[57] ABSTRACT

Tin-free steel sheets exhibiting improved retorting resistance with respect to paint adhesion are produced by chromium plating a steel sheet through cathodic electrolysis in a chromium ion-containing solution, reversely electrolyzing the sheet by a successive anodizing treatment in said solution, and subjecting the sheet to an electrolytic treatment in an aqueous chromate solution. The $SO_4^{--}$ concentration of the chromate solution used in the electrolytic chromate treatment should be limited to the range of 0.01 to 0.10 gram per liter of the solution.

1 Claim, 4 Drawing Figures

METHOD OF PRODUCING TIN-FREE STEEL SHEETS HAVING IMPROVED RESISTANCE TO RETORTING TREATMENT

BACKGROUND OF THE INVENTION

This invention relates to a method of producing tin-free steel sheets having improved retorting resistance, and more particularly, to a method of producing tin-free steel sheets exhibiting improved retorting resistance with respect to paint adhesion and suitable for use as bonded can-forming material.

Electrolytic chromate treated steel sheets also known as tin-free steel (TFS) of chromium type have improved properties as can-forming material and are regarded as a substitute for tin plates. The demand for them is increasing in these years.

Since TFS has metallic chromium and hydrated chromium oxide coatings on the surface, it does not possess sufficient weldability. A can must be fabricated from a TFS sheet by applying an exposy-phenol resin paint to a blank and bonding the mating edges of the blank with a polyamide adhesive to form a can barrel.

Recently, the extent of application of TFS cans has been further spread. That is, TFS cans are not only used for so-called cold packs prepared by packing contents such as carbonated beverage and beer in cans at relatively low temperatures, but also used for so-called hot packs prepared by packing contents such as fruit juice and coffee in cans at relatively high temperatures for sterilization. TFS is also used in those cans requiring a high temperature retorting treatment for sterilization at the end of packing. In the latter applications, there often occurred accidents of rupture of can barrels.

This can barrel rupture occurs in bonded TFS cans during hot packing and retorting treatment because hot water penetrates through the paint film at the barrel junction to deteriorate the interfacial adhesion between the paint film and the TFS substrate to eventually separate the paint film from the TFS substrate.

Research works revealed that sulfuric acid, which was conventionally added to chromium plating baths and electrolytic chromate baths, was codeposited in the hydrated chromium oxide coating and the sulfuric acid codeposited was dissolved out during the subsequent retorting treatment to give rise to the paint film-TFS substrate interfacial separation. Several proposals were made to avoid sulfuric acid codeposition, for example, by using sulfuric acid-free plating baths, or by excluding sulfuric acid from acid pickling solutions used in a pretreatment. However, these techniques had a number of industrial problems in that manufacture efficiency is considerably lowered, product quality is less consistent, and yield is low as compared with the traditional techniques.

It is, therefore, an object of the present invention to eliminate the above-mentioned problems of the prior art and to provide an improved method of producing tin-free steel sheets which do not undergo any interfacial separation between a TFS substrate and a paint build-up during a retorting treatment.

The inventors previously proposed in Japanese Patent Application No. SHO-56-62766 a technique capable of overcoming the problem of sulfuric acid codeposition wherein chromium plating is followed by a reverse electrolysis treatment of anodizing the plated steel sheet in the chromium plating solution, and then by an electrolytic chromate treatment in an aqueous chromate solution.

The electrolytic chromate treating solution may desirably contain sulfate ions as little as possible. However, commercially available chromates ($CrO_3$) contain sulfate as one of impurities. It is thus imperative that electrolytic chromate solutions prepared therefrom contain the sulfate contaminant. An electrolytic chromate solution whose sulfate concentration is as low as 0.005 g/l will be prepared from a reagent grade chromate which is too expensive to gain commercial acceptance. The use of commercial grade chromates results in electrolytic chromate solutions, some of which are successful in improving retorting resistance while the remainings fail.

Making researches how the retorting resistance depends upon the concentration of $SO_4^{--}$ in the chromate solution used in the electrolytic chromate treatment after the reverse electrolysis, the inventors have found that improved retorting resistance is obtained provided that the concentration of $SO_4^{--}$ in the electrolytic chromate solution is limited within a certain range.

SUMMARY OF THE INVENTION

According to the present invention, there is provided a method of producing a tin-free steel sheet exhibiting improved retorting resistance with respect to paint adhesion, comprising the steps of chromium plating a steel sheet through cathodic electrolysis in a chromium ion-containing aqueous solution to form a plating consisting essentially of metallic chromium, reversely electrolyzing the chromium plated steel sheet by a successive anodizing treatment in said aqueous solution, and subjecting the reversely electrolyzed steel sheet to an electrolytic chromate treatment in another aqueous solution containing sulfuric acid and at least one selected from the group consisting of chromic acid, chromates, and dichromates, the improvement wherein said aqueous solution used in the electrolytic chromate treatment contains sulfate ions at a concentration of 0.01 to 0.10 gram per liter of the solution.

BRIEF DESCRIPTION OF THE DRAWING

The above and other objects, features, and advantages of the present invention will be readily understood by reading the following description in conjunction with the accompanying drawings, in which.

DETAILED DESCRIPTION OF THE INVENTION

Figure 1A:
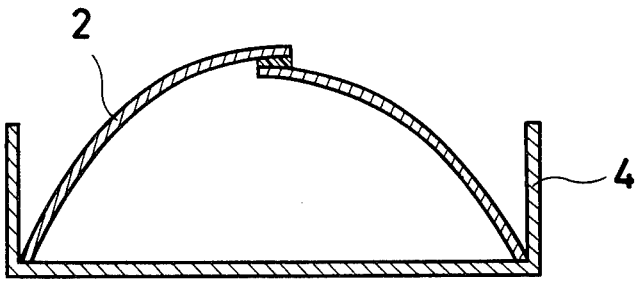
FIG. 1A is a cross-sectional view of a specimen consisting of adhesive bonded TFS pieces and being press fitted in an angle for a retorting test.

The present invention is directed to TFS sheets having a plating of metallic chromium ranging from 50 to 200 mg per square meters on each sheet surface and a coating of hydrated chromium oxides ranging from 5 to 30 mg per square meters on the metallic chromium plating surface. TFS sheets generally have a metallic chromium plating of 50 to 200 mg/m$^2$ because thinner platings of less than 50 mg/m$^2$ have poor corrosion resistance. Thicker platings exceeding 200 mg/m$^2$ do not provide an additional improvement in corrosion resistance.

TFS sheets having a coating of hydrated chromium oxides of 5 to 30 mg/m$^2$ (calculated as metallic chromium) because thinner coatings of less than 5 mg/m$^2$ do not provide the necessary paint adhesion. Thicker coatings exceeding 30 mg/m$^2$ have a poor appearance and are prone to cracking during subsequent processing and thus impractical. The most desirable range is 8–25 mg/m$^2$.

The chromium plating bath and electrolytic chromate bath used in TFS manufacture are basically aqueous solutions of chromic acid, chromates and/or dichromates, to which a variety of assistants are added. Most of these assistants contain one or more anions such as sulfate and fluoride anions, and such anions are codeposited in a substantial proportion in hydrated chromium oxide coatings formed on the TFS surface. Particularly, the sulfate codeposited in the coating is detrimental because it can be dissolved out during a retorting treatment of bonded TFS cans to give rise to paint film-TFS interfacial separation as described earlier.

The inventors carried out a basic experiment in order to find adequate conditions for the electrolytic chromate treatment to assure that the resulting TFS sheets show consistently excellent retorting resistance with respect to paint adhesion.

Steel sheets were electrolytically degreased, rinsed and pickled with sulfuric acid in a conventional manner before they were cathodically treated in a chromium plating bath having a composition of 100 to 200 g of $CrO_3$, 5 to 8 g of $Na_2SiF_6$ and 0.5 to 1 g of $H_2SO_4$ per liter of the bath. The chromium plated steel sheets were successively subjected to reverse electrolysis in the same bath while they were set as an anode. The steel sheets were rinsed again with water. The steel sheets were further subjected to an electrolytic chromate treatment in aqueous chromate solutions prepared from reagent grade chromate ($CrO_3$) with or without adding $H_2SO_4$ thereto while they were set as a cathode.

In order to examine the paint adhesion to the thus obtained TFS sheets during retorting treatment, a retorting test was carried out on the TFS sheets having paint applied thereon by the following procedure. A TFS sheet was coated on one surface with an epoxy-phenol resin paint in an amount of 60 mg/dm$^2$ and baked at 210° C. for 12 minutes. The sheet was then coated on the other surface with the same paint in an amount of 25 mg/dm$^2$ and baked under the same conditions as above. The double-coated sheet was cut to pieces of 70 mm wide by 60 mm long. Two pieces were bonded with an adhesive along their edges.

Figure 1B:
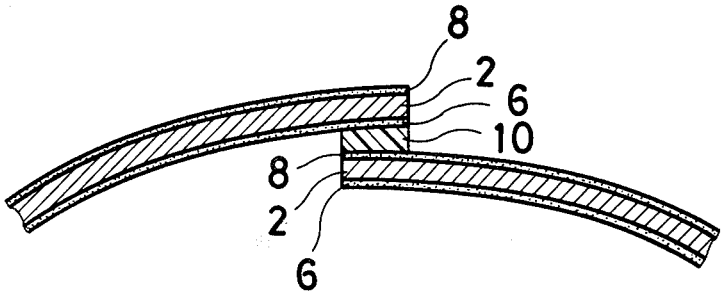
FIG. 1B is an enlarged view of a bonded portion of the specimen which is bounded by a broken line circle in FIG. 1A.

FIG. 1A shows a specimen consisting of two bonded pieces 2 and FIG. 1B is an enlarged view of the bonded portion of the specimen. As best shown in FIG. 1B, one piece 2 was partially overlaid on another piece 2 over an overlapping distance of 8 mm between their mating longitudinal edges while an adhesive nylon film 10 of 100 μm thick was sandwiched between a thick paint build-up 6 of one piece 2 and a thin paint build-up 8 of the other piece 2. It should be understood that the thick and thin paint build-ups 6 and 8 were formed on the opposed surfaces of a sheet by applying a phenolepoxy resin paint to 60 and 25 mg/dm$^2$, respectively, as described above. Using a hot press, the sandwich of the adhesive film between the partially overlapped pieces was presssure bonded by preheating it at 200° C. for 120 seconds and further heating at 200° C. under a pressure of 3 kg/cm$^2$ for 30 seconds. Ten specimens were prepared in this manner. As shown in FIG. 1A, each specimen consisting of adhesive bonded two pieces was bent to substantially the same curvature as a can barrel before it was press fitted between the corners of an angle 4 having a bottom length of 70 mm. These test assemblies were kept for 150 and 300 minutes in a retort at 125°–130° C. and 1.6–1.7 kg/cm$^2$. After the test assemblies were taken out of the retort, the specimens were examined for bond failure. The number of separated specimens in a set of 10 specimens is the index representative of retorting resistance of a paint-coated TFS sheet.

Figure 2:
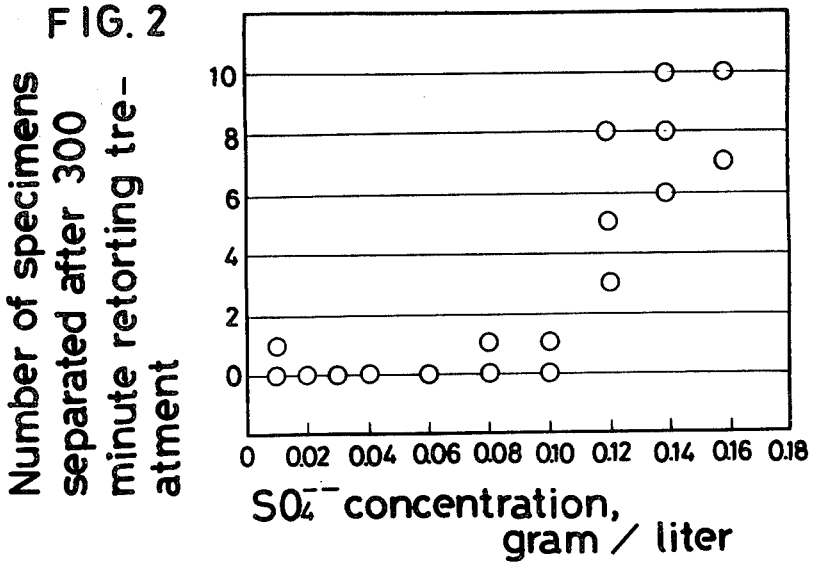
FIG. 2 is a diagram showing the retorting resistance of paint adhesion to TFS sheets in relation to the $SO_4^{--}$ concentration of the electrolytic chromate solution.

The test results are shown in FIG. 2 by plotting the number of separated specimens in relation to the concentration of $SO_4^{--}$ in gram/liter in the chromate solutions used in the electrolytic chromate treatment. As evident from FIG. 2, retorting resistance is suddenly aggravated when the $SO_4^{--}$ concentration exceeds 0.10 g/l, although retorting resistance is kept very well at $SO_4^{--}$ concentrations of lower than 0.10 g/l (inclusive).

Figure 3:
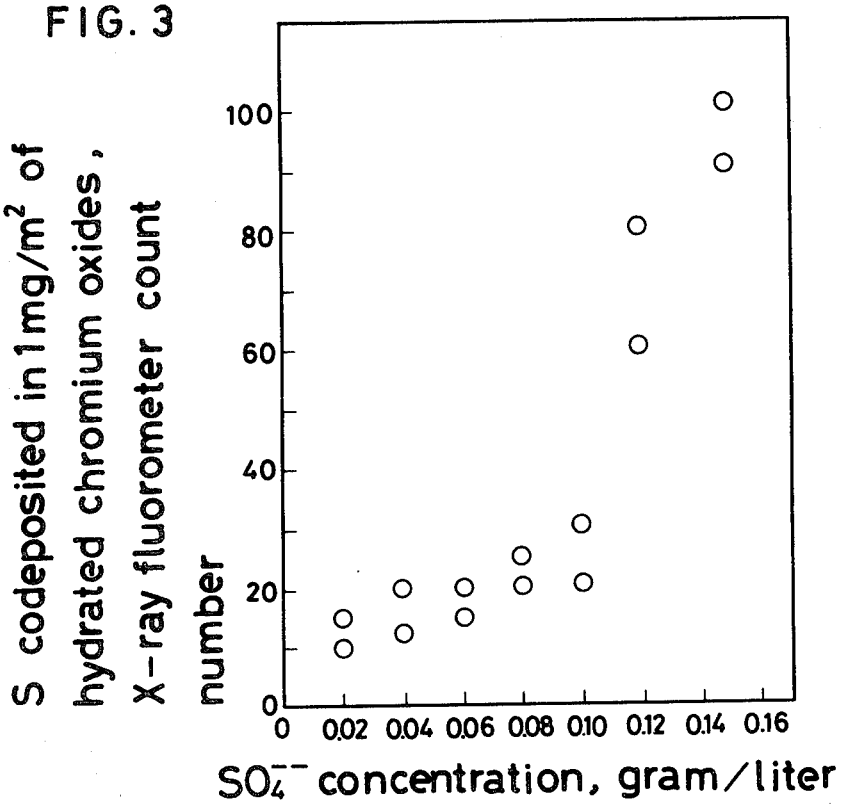
FIG. 3 is a diagram showing the amount of sulfur codeposited with hydrated chromium oxides on TFS sheets in relation to the $SO_4^{--}$ concentration of the electrolytic chromate solution.

FIG. 3 is a diagram in which the amount of sulfer (S) codeposited in 1 mg/m$^2$ of hydrated chromium oxides is plotted in relation to the concentration of $SO_4^{--}$ in gram/liter in the chromate solutions used in the electrolytic chromate treatment. As evident from FIG. 3, the amount of sulfur codeposited suddenly increases when the $SO_4^{--}$ concentration exceeds 0.10 g/l.

In order to make TFS sheets having improved retorting resistance, not only the reverse electrolysis should be effected after the chromium plating so as to reduce the sulfate codeposited with hydrated chromium oxides, but the electrolytic chromate treatment following the reverse electrolysis and rinsing should also be effected in a chromate solution having a limited $SO_4^{--}$ concentration of 0.10 g/l or lower. As the $SO_4^{--}$ conentration is further lowered below 0.10 g/l, the effect thereof on retorting resistance is saturated or leveled and the operating cost increases. For commercial practice, the lower limit of the $SO_4^{--}$ concentration in the electrolytic chromate solution should be 0.01 g/l.

The following example is set forth by way of illustration and not by way of limitation.

EXAMPLE

A cold rolled steel sheet designated T4CA having a thickness of 0.22 mm was electrolytically degreased in a 5% homezarine solution at a temperature of 80° C. and a current density of 10 ampere/dm$^2$, rinsed with water, immersed in a 10% $H_2SO_4$ at 40° C. for 5 seconds, and rinsed again with water. The sheet was then subjected to the following treatments in sequence:

(A) chromium plating step, (B) reverse electrolysis step, and (C) electrolytic chromate treatment. Steps (A) and (B) were successively carried out in the same electrolytic bath. Cold water rinsing and hot water rinsing were carried out both between steps (B) and (C) and at the end of step (C).

Conditions used in the respective steps are shown in Table 1. The chromium plating was carried out in two different baths. The anodizing treatment was carried out at an electricity quantity of 1 coulomb/$dm^2$ except that sample No. 1 was not subjected to reverse electrolysis for comparison purpose. The baths used in the electrolytic chromate treatment contained 60 g/l of $CrO_3$ while the concentration of $H_2SO_4$ was varied from 0.01 g/l to 0.20 g/l.

The electrolytically treated TFS sheets were determined for paint adhesion under retorting conditions by the same test procedure as used in the above-described basic experiment. The results are also shown in Table 1.

TABLE 1

| Sample No. | | Chromium plating | Reverse electrolysis | Electrolytic chromate treatment $CrO_3$ (g/l) | $H_2SO_4$ (g/l) | Bath temp. | Electrolytic condition | Retorting resistance* 150 min. | 300 min. |
|---|---|---|---|---|---|---|---|---|---|
| 1 | Comparison | $CrO_3$ 150 g/l | no | | 0.01 | | 15 A/$dm^2$ 1.0 sec. | 10 | 10 |
| 2 | Invention | $Na_2SiF_6$ 5 g/l | | | 0.01 | | | 0 | 0 |
| 3 | Comparison | $H_2SO_4$ 0.6 g/l | | | 0.20 | | | 8 | 10 |
| 4 | " | 50° C. | | | 0.12 | | | 1 | 8 |
| 5 | Invention | 50 A/$dm^2$ | | | 0.10 | | | 0 | 1 |
| 6 | " | 1.4 sec. | 5 A/$dm^2$ 0.2 sec. | 60 | 0.06 | 40° C. | 15 A/$dm^2$ 20 sec. | 0 | 0 |
| 7 | " | | | | 0.02 | | | 0 | 0 |
| 8 | " | $CrO_3$ 150 g/l $H_2SO_4$ 0.6 g/l | | | 0.02 | | | 0 | 0 |
| 9 | " | 50° C. 50 A/$dm^2$ | | | 0.10 | | | 0 | 1 |
| 10 | Comparison | 1.4 sec. | | | 0.20 | | | 7 | 10 |

*Retorting resistance of electrolytically treated steel sheets having paint applied to the opposed surfaces, expressed by the number of separated specimens in a set of 10 specimens each consisting of paint built-up TFS sheets bonded with an adhesive film after exposure to a retorting treatment for 150 and 300 minutes.

As seen from the data in Table 1, TFS sheets having improved retorting resistance are obtained through a sequence of steps of chromium plating, reverse electrolysis, and electrolytic chromate treatment as long as the chromate solution has a limited $SO_4^{--}$ concentration of 0.01 to 0.10 g/l.

As demonstrated by the above Example, the present invention allows tin-free steel sheets having improved retorting resistance to be produced by carrying out an electrolytic chromate treatment in a chromate solution whose $SO_4^{--}$ concentration is limited to the range from 0.01 to 0.10 g per liter of the solution.

What is claimed is:

1. A method of producing a tin-free steel sheet having thereon a plating of metallic chromium ranging from 50 to 200 mg per square meters and a coating of hydrated chromium oxides ranging from 5 to 30 mg per square meters on the metallic chromium plating surface and exhibiting improved retorting resistance, comprising the steps of chromium plating a steel sheet through cathodic electrolysis in a chromium ion-containing aqueous solution to form a plating consisting essentially of metallic chromium, reversely electrolyzing the chromium plated steel sheet by a successive anodizing treatment in said aqueous solution, and subjecting the reversely electrolyzed steel sheet to an electrolytic chromate treatment in another aqueous solution containing sulfuric acid and at least one selected from the group consisting of chromic acid, chromates, and dichromates, the improvement wherein said aqueous solution used in the electrolytic chromate treatment has a sulfate concentration limited to the range of 0.01 to 0.10 gram per liter of the solution.

* * * * *